US005886569A

United States Patent [19]

Mitsuishi

[11] Patent Number: 5,886,569

[45] Date of Patent: Mar. 23, 1999

[54] SEMICONDUCTOR INTEGRATED CIRCUIT DEVICE WITH CONTROL CIRCUIT FOR CONTROLLING AN INTERNAL SOURCE VOLTAGE

[75] Inventor: Masafumi Mitsuishi, Tokyo, Japan

[73] Assignee: NEC Corporation, Tokyo, Japan

[21] Appl. No.: 733,649

[22] Filed: Oct. 17, 1996

[30] Foreign Application Priority Data

Oct. 25, 1995 [JP] Japan ..... 7-276073

[51] Int. Cl.[6] ..... G05F 1/10

[52] U.S. Cl. ..... 327/540; 327/543; 327/546; 365/226

[58] Field of Search ..... 327/538, 540, 327/543, 546; 365/201, 226, 189.09; 324/158.1, 763

[56] References Cited

U.S. PATENT DOCUMENTS

| | | | |
|---|---|---|---|
| 5,121,007 | 6/1992 | Aizaki | 307/475 |
| 5,321,653 | 6/1994 | Suh et al. | 365/189.09 |
| 5,349,559 | 9/1994 | Park et al. | 365/201 |
| 5,396,113 | 3/1995 | Park et al. | 327/543 |
| 5,428,299 | 6/1995 | Koshikawa | 324/763 |
| 5,656,944 | 8/1997 | Choi | 324/763 |

FOREIGN PATENT DOCUMENTS 3149876 6/1991 Japan .

*Primary Examiner*—Timothy P. Callahan
*Assistant Examiner*—Jung Ho Kim
*Attorney, Agent, or Firm*—Whitman, Curtis & Whitman

[57] ABSTRACT

There is provided a semiconductor integrated circuit device including an external source voltage detector for keeping transmitting a first signal after detecting that an absolute value of external source voltage provided externally of the semiconductor integrated circuit device has exceeded a first threshold voltage, and an internal source voltage generator for generating a constant internal source voltage regardless of the external source voltage while the absolute value of the external source voltage is in a predetermined range, and providing the external source voltage as it is as an internal source voltage while the first signal is being kept transmitted. The semiconductor integrated circuit device makes it possible to externally control an internal source voltage to be applied to an internal circuit mounted in an IC chip without addition of control terminals over a wide range of an external source voltage.

15 Claims, 13 Drawing Sheets

SEMICONDUCTOR INTEGRATED CIRCUIT DEVICE WITH CONTROL CIRCUIT FOR CONTROLLING AN INTERNAL SOURCE VOLTAGE

BACKGROUND OF THE INVENTION

Field Of The Invention

The invention relates to a semiconductor integrated circuit device, and more particularly to a control circuit for controlling an internal source voltage in a semiconductor integrated circuit device such as a semiconductor memory device which transforms an externally provided source voltage to an internal source voltage to thereby use the internal source voltage as a source voltage for operating the semiconductor integrated circuit device.

DESCRIPTION OF THE RELATED ART

A semiconductor integrated circuit device has been suggested in Japanese Unexamined Patent Publication No. 3-149876. FIG. 1 is a block diagram of the suggested semiconductor integrated circuit device. An IC chip 1 includes a circuit for generating an internal source voltage 3 and an internal circuit 4. An external source voltage VEE and a grounded voltage GND are applied to the IC chip 1. The internal source voltage generating circuit 3 establishes a constant internal source voltage Vint from the external source voltage VEE, and provides the thus established internal source voltage Vint to the internal circuit 4 to thereby drive the internal circuit 4.

In the illustrated IC chip 1, an internal source voltage is controlled by providing the IC chip 1 with an external terminal C through which a control signal is transmitted to the internal source voltage generating circuit 3 to thereby deactivate the circuit 3. As an alternative, an internal source voltage may be controlled by providing a switch (not illustrated) for separating the circuit 3 from a wiring through which the internal source voltage Vint is running, to thereby keep the wiring in floating condition. In addition, the wiring is connected to an external terminal D, through which a source voltage is applied to the IC chip 1. Thus, it is possible to control the internal source voltage from the outside of the IC chip 1.

A function of carrying out burn-in test, which is to be carried out for the purpose of evaluating reliability of circuit devices, may be added to a semiconductor integrated circuit by varying an internal source voltage Vint in proportion to an external source voltage. FIG. 2 is a block diagram of a conventional semiconductor integrated circuit to which the burn-in test function is added.

In FIG. 2, parts or elements corresponding to those of FIG. 1 have been provided with the same reference numerals. An IC chip 1 illustrated in FIG. 2 includes the internal source voltage generating circuit 3 for supplying an internal source voltage Vint, the internal circuit 4, and a burn-in test control circuit 5 for controlling the internal source voltage Vint for the sake of burn-in test. When a normal external source voltage is applied to the IC chip 1, only the internal source voltage generating circuit 3 is activated, and thus, a constant internal source voltage Vint is supplied to the internal circuit 4. On the other hand, when an absolute value of the external source voltage exceeds a normal operation voltage, the burn-in test control circuit 5 is activated to thereby vary the internal source voltage Vint in proportion to the external source voltage, thereby it is possible to carry out burn-in test to the internal circuit 4 for evaluating reliability of the IC chip 1.

FIG. 3 shows an example of characteristic of the internal source voltage Vint in the IC chip 1 illustrated in FIG. 2. When an absolute value of an external source voltage is relatively small, the internal source voltage Vint is equal to an external source voltage. When an absolute value of an external source voltage is about a usually used voltage Va, the internal source voltage Vint is fixed at a constant voltage $V_1$. As an absolute value of an external source voltage is increasing, the internal source voltage Vint is varied in accordance with an external source voltage by virtue of the operation of the burn-in test control circuit 5.

The above mentioned conventional semiconductor integrated circuit device has problems as follows.

First, the semiconductor integrated circuit device illustrated in FIG. 1 has to have two terminals, namely the terminal C through which control signals are transmitted and the terminal D through which an external source voltage is supplied in order to control an internal source voltage. However, those two terminals are unnecessary for normal operation of the device.

The semiconductor integrated circuit device illustrated in FIG. 2 has a shortcoming that an internal source voltage Vint is made to remain at a constant voltage $V_1$ when an absolute value of an external source voltage is about an usually used voltage Va, as illustrated in FIG. 3, and hence it is impossible to control an internal source voltage Vint with an external source voltage. In addition, even if an absolute value of an external source voltage is further increased, it is quite difficult or almost impossible to exactly control an internal source voltage Vint with an external source voltage due to fluctuation of process.

SUMMARY OF THE INVENTION

In view of the above mentioned problems of the conventional semiconductor integrated circuit devices, it is an object of the present invention to provide a semiconductor integrated circuit device capable of controlling an internal source voltage from outside over a wide range of an external source voltages without additional provision of terminals such as control terminals.

Another object of the present invention is to provide a semiconductor integrated circuit device capable of having an internal source voltage characteristic for both carrying out burn-in test and normal operation.

There is provided a semiconductor integrated circuit device including an external source voltage detector for keeping transmitting a first signal after detecting that an absolute value of external source voltage provided externally of the semiconductor integrated circuit device has exceeded a first threshold voltage, and an internal source voltage generator for generating a constant internal source voltage regardless of the external source voltage while the absolute value of the external source voltage is in a predetermined range, and providing the external source voltage as it is as an internal source voltage while the first signal is being kept transmitted.

There is further provided a semiconductor integrated circuit device including an external source voltage detector for keeping transmitting a first signal after the detector detects that an absolute value of external source voltage provided externally of the semiconductor integrated circuit device has exceeded a first threshold voltage, an internal source voltage generator for generating a constant internal source voltage regardless of the external source voltage while the absolute value of the external source voltage is in a predetermined range, and providing the external source voltage as it is as an internal source voltage while the first signal is being kept transmitted, and a terminal for externally transmitting an output transmitted from the internal source voltage generator.

The external source voltage detector may be designed to keep transmitting the first signal until the absolute value of the external source voltage is dropped to a second threshold voltage which is smaller than the first threshold voltage.

It is preferable that the external source voltage detector transmits a second signal as well as the first signal. Herein, the second signal corresponds to a negative signal against the first signal. Namely, the second signal includes negation of what is indicated by the first signal.

The above mentioned predetermined range may include the first threshold voltage as an upper limit, and the second threshold voltage as a lower limit.

The external source voltage detector may be structured in various fashions. For instance, the external source voltage detector includes a first voltage generator for generating a first constant voltage greater than a minimum voltage of the external source voltage, a second voltage generator for generating a second constant voltage smaller than a maximum voltage of the external source voltage, a comparator for comparing the first and second constant voltages to each other, and a memory for storing therein results of comparison carried out by the comparator.

Similarly, the internal source voltage generator may be structured in various fashions. For instance, the internal source voltage generator includes a reference voltage generator for outputting the external source voltage as the constant internal source voltage before the first signal is transmitted. The reference voltage generator is controlled so that it is deactivated to provide the external source voltage as it is as an internal source voltage after the first signal has been transmitted.

The memory may also be structured in many fashions. For instance, the memory preferably includes a NAND gate which receives the results of comparison as a first input, an inverter for inverting an output transmitted from the NAND gate, and a resistor for pulling-up a second input of the NAND gate to grounded potential. An output transmitted from the inverter is designed to be fed back to the second input of the NAND gate, and an output transmitted from the NAND gate constitutes the first signal. The memory may further include a second inverter for inverting the first signal, the thus inverted signal being externally transmitted as a complementary signal together with the first signal. The first signal and the inverted signal preferably have hysteresis characteristic in which levels are switched between high and low when the absolute value of the external source voltage is equal to the first or second threshold voltage.

For another instance, the memory may be designed to have a NOR gate which receives the results of comparison as a first input, an inverter for inverting an output transmitted from the NOR gate, and a resistor for pulling-up a second input of the NAND gate to a supply voltage. An output transmitted from the inverter is fed back to the second input of the NOR gate, and an output transmitted from the NOR gate constitutes a negative signal including negation of what is indicated by the first signal.

The semiconductor integrated circuit device may further include a counter for counting the number of transmission of the first signal, the first signal being transmitted to the memory when the number of transmission of the first signal reaches a predetermined number.

As mentioned earlier, in the semiconductor integrated circuit, when the external source voltage detector detects that an absolute value of an external source voltage exceeds an absolute value of a voltage predetermined depending in on a circuit constant, the external source voltages detector stores therein the detection results for a wide range of an external source voltage. The internal source voltage generator generates a constant internal source voltage regardless of fluctuation in an external source voltage when an absolute value of an external source voltage is greater than an absolute value of the predetermined voltage. The detection results or output transmitted from the external source voltage detector is input to the internal source voltage generator. Thus, circuits driven with an internal source voltage come to have hysteresis characteristic against fluctuation in an external source voltage, so that an internal source voltage becomes equal to an external source voltage in a wide range of an external source voltages without additional provision of external control terminals. As a result, it is now possible to externally, exactly control an internal source voltage.

In accordance with the present invention, it is possible to exactly and readily measure a current running through an internal circuit by disposing a terminal externally of the semiconductor integrated circuit device, through which terminal an internal source voltage can be measured.

In the semiconductor integrated circuit device, a counter may be disposed between the external source voltage detector and the memory to thereby equalize an internal source voltage to an external source voltage by increasing and decreasing an external source voltage by a predetermined number. Thus, it is possible to prevent an internal source voltage from being unexpectedly equalized to an external source voltage. As a result, the semiconductor integrated circuit device can have internal source voltage characteristic both for burn-in test and for normal operation.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 4:
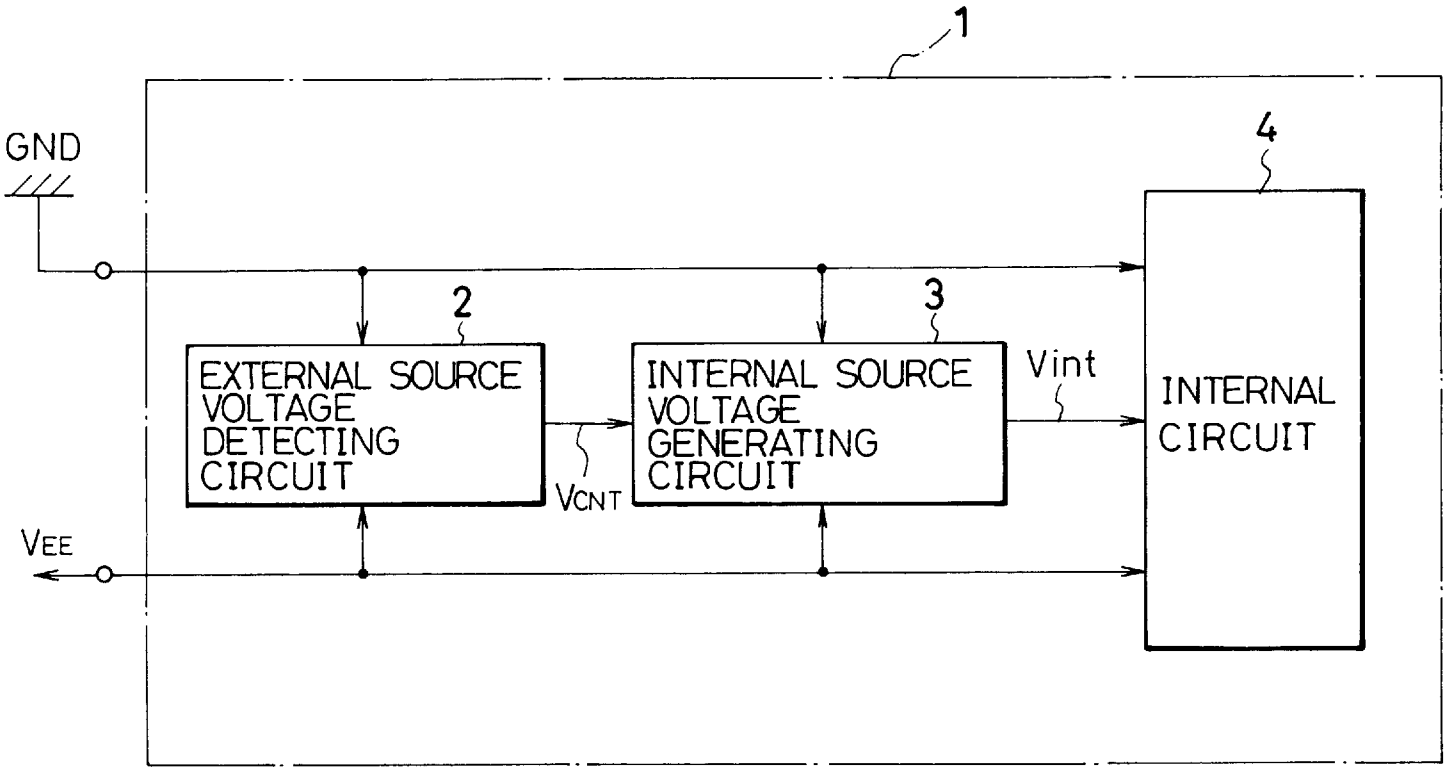
FIG. 4 is a block diagram of the first embodiment in accordance with the present invention.

FIG. 4 is a circuit block diagram of a semiconductor integrated circuit device fabricated in accordance with the first embodiment of the present invention. An IC chip 1 includes a circuit 2 for detecting an external source voltage, a circuit 3 for generating an internal source voltage, and an internal circuit 4. Herein, it is assumed that a grounded voltage GND make a maximum voltage, and an external source voltage VEE make a minimum voltage.

Figure 6:
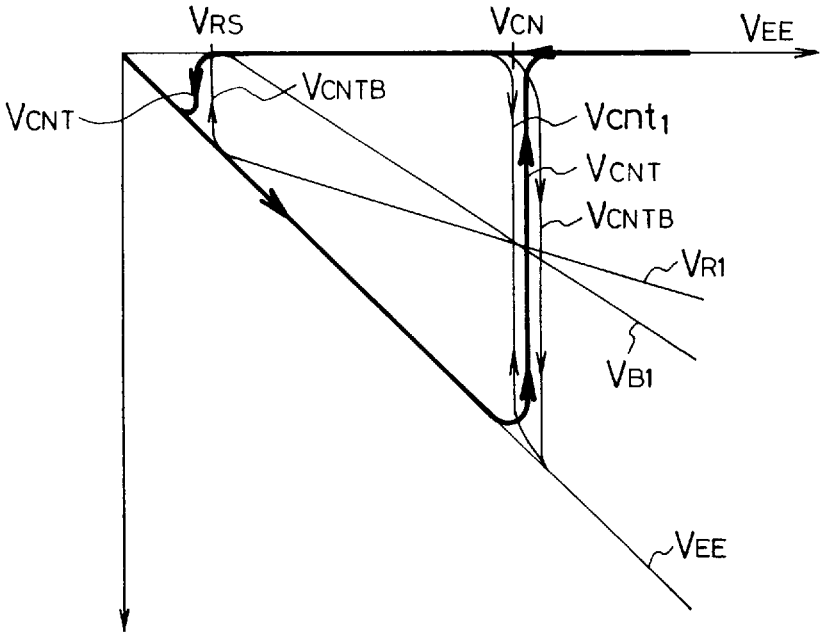
FIG. 6 is a graph showing characteristic of contact voltages to an external source voltage in the first embodiment.

The external source voltage VEE is supplied to the external source voltage detecting circuit 2, which in turn transmits a detection signal VCNT as an output to the internal source voltage generating circuit 3. As illustrated in FIG. 6, when the external source voltage detecting circuit 2 detects that an absolute value of an external source voltage becomes greater than a predetermined threshold voltage VCN, the detection signal VCNT switches from low level to high level.

The external source voltage detecting circuit 2 has a function of keeping the detection signal VCNT at high level until an absolute value of an external source voltage VEE is reduced to a sufficiently small voltage VRS. Accordingly, the detection signal VCNT has a hysteresis characteristic to fluctuation in the external source voltage VEE.

The external source voltage detecting circuit 2 may be designed to transmit a negative signal including negation of what is indicated by the detection signal VCNT, as well as the detection signal VCNT. This arrangement makes it possible to use the output of the circuit 2 as a differential signal.

The internal source voltage generating circuit 3 receives the detection signal VCNT as a control input from the external source voltage detecting circuit 2, and transmits an internal source voltage Vint to the internal circuit 4. The internal source voltage generating circuit 3 has a function of controlling the internal source voltage Vint so that the internal source voltage Vint remains constant regardless of fluctuation in the external source voltage VEE, similarly to a conventional circuit for generating an internal source voltage. In addition, the internal source voltage generating circuit 3 is constructed to be controlled by the detection signal VCNT, and hence the internal source voltage Vint is varied in accordance with fluctuation in the detection signal VCNT. Accordingly, the internal source voltage Vint also has a hysteresis characteristic to the fluctuation in the external source voltage VEE.

Figure 5:
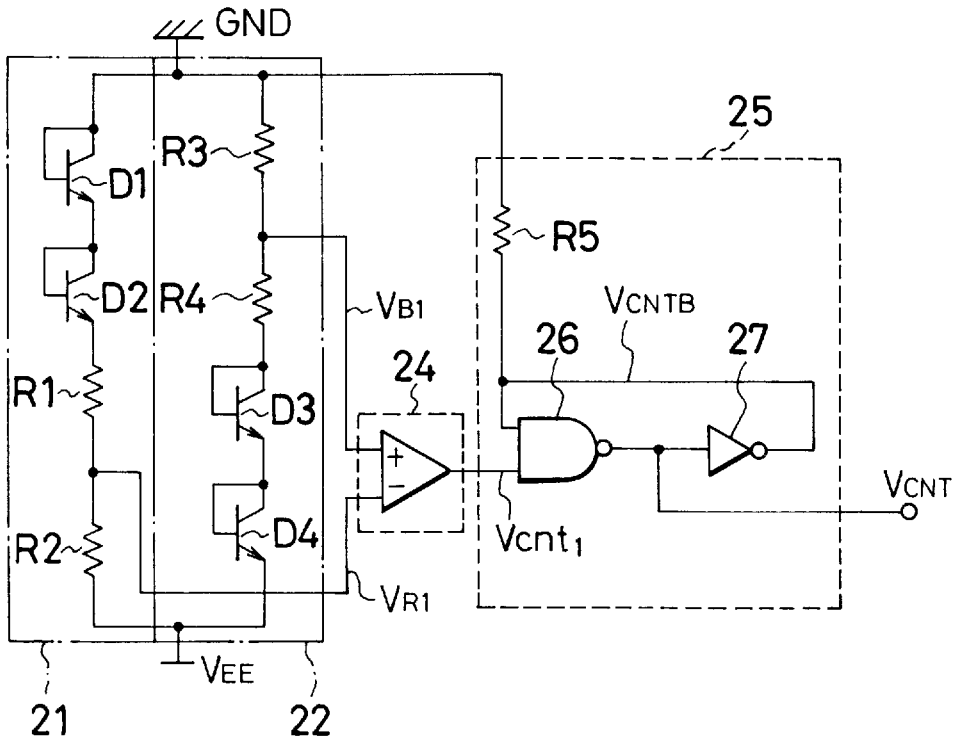
FIG. 5 is a circuit diagram of an example of an external source voltage generator in the first embodiment.

FIG. 5 illustrates an example of the external source voltage detecting circuit 2. The external source voltage detecting circuit 2 is comprised of a first constant voltage source circuit 21, a second constant voltage source circuit 22, a comparator 24, and a memory section 25.

The first constant voltage source circuit 21 includes transistors D1 and D2 connected to each other so that they can act as a diode, and resistors R1 and R2, all of which are connected in series in this order, between the grounded voltage GND and the external source voltage VEE. A constant voltage VR1 is taken out from a connection between the resistors R1 and R2. Accordingly, the first constant voltage source circuit 21 establishes a constant voltage VR1 smaller than the maximum voltage, that is, the grounded voltage GND, and transmits the constant voltage VR1 to the comparator 24.

The second constant voltage source circuit 22 includes resistors R3 and R4 and transistors D3 and D4 connected to each other so that they can act as a diode, between the grounded voltage GND and the external source voltage VEE, all of which are connected in series in this order. A constant voltage VB1 is taken out from a connection between the resistors R3 and R4. Accordingly, the second constant voltage source circuit 22 establishes a constant voltage VB1 greater than the minimum voltage, that is, the external source voltage VEE, and transmits the constant voltage VB1 to the comparator 24.

The comparator 24 compares the constant voltages VR1 and VB1 to each other, and transmits comparison result to the memory section 25 for storing therein.

The memory section 25 is comprised of a NAND gate 26 which receives the results of comparison as a first input from the comparator 24, an inverter 27 for inverting an output transmitted from the NAND gate 26, and a resistor R5 for pulling-up a second input of the NAND gate 26 to the grounded potential GND. The inverted output VCNTB transmitted from the inverter 27 is fed back to the second input of the NAND gate 26, and an output transmitted from the NAND 26 gate establishes the detection signal VCNT.

The memory section 25 may have an additional inverter (not illustrated) for inverting the detection signal VCNT. The thus inverted signal VCNTB is externally transmitted as a complementary signal together with the detection signal VCNT.

The comparator 24, the NAND gate 26 and the inverter 27 are driven with the external source voltage VEE.

Hereinbelow is explained the operation of the circuit illustrated in FIG. 5 with reference to FIG. 6 showing a characteristic of the circuit to the external source voltage VEE at various voltage level.

First, there is assumed a case wherein an absolute value of the external source voltage VEE is increased. When an absolute value of the external source voltage VEE is relatively low, the output level VR1 of the first constant voltage source circuit 21 is smaller than the output level VB1 of the second constant voltage source circuit 22. The output levels VR1 and VB1 of the first and second constant voltage source circuits 21 and 22 get to be equal to each other at a threshold voltage VCN. As an absolute value of the external source voltage VEE is increased, the output level VR1 becomes greater than the output level VB1.

These output levels VR1 and VB1 are transmitted into the comparator 24. The output Vcntl transmitted from the comparator 24 is switched from high level to low level when an absolute value of the external source voltage VEE gets equal to the threshold voltage VCN. Due to the output Vcntl being transmitted into the memory circuit 25, the detection signal VCNT, which is an output transmitted from the NAND gate 26, is switched from low level to high level, and thus the inverted signal VCNTB is switched from high level to low level, since an initial value of the detection signal VCNT is fixed at high level by means of the resistor R5.

Next will be explained a case where an absolute value of the external source voltage VEE is decreased. In this case, the output Vcntl is switched from low level to high level at the threshold voltage VCN. On the other hand, the detection signal VCNT and the inverted signal VCNTB are kept its level as it is by means of the memory section 25, and hence the detection signal VCNT and the inverted signal VCNTB are fixed at high and low levels, respectively, even if an absolute value of the external source voltage VEE gets smaller than the threshold voltage VCN. When an absolute value of the external source voltage VEE gets equal to a sufficiently small voltage VRS, the detection signal VCNT is switched from high level to an initial voltage of low level, and at the same time, the inverted signal VCNTB is switched from low level to an initial voltage of high level. The voltage VRS is determined in dependence on both a size of the inverter 27 and a resistance value of the resistor R5.

Accordingly, the detection signal VCNT and the inverted signal VCNTB have a hysteresis characteristic where the levels thereof are switched between low and high when the external source voltage VEE is equal to the threshold voltage VCN and the small voltage VRS.

In general, a semiconductor memory includes a constant voltage source circuit such as the first and second constant voltage source circuits 21 and 22 whose output level is different from that of the semiconductor memory. Thus, it is possible to divide output level of a constant voltage source circuit with a resistor or resistors to thereby change the output level to desired output level VR1 or VB1.

Figure 7:
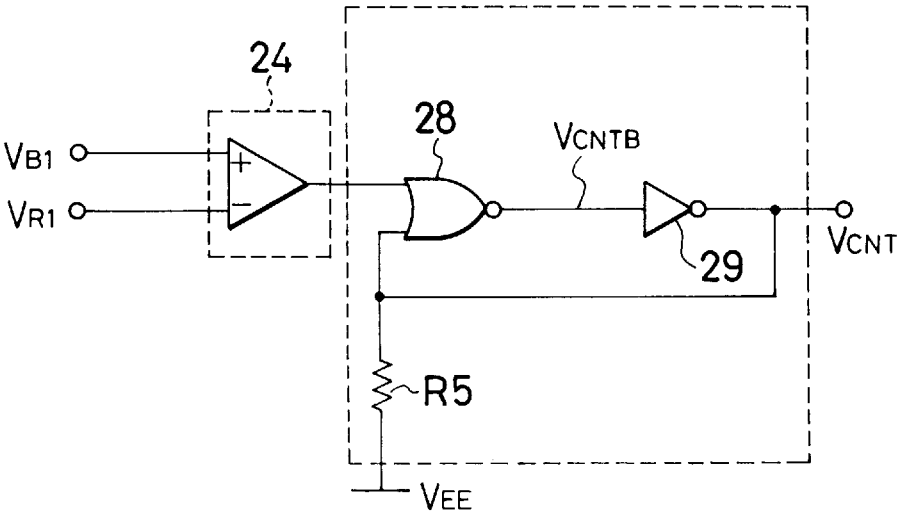
FIG. 7 is a circuit diagram of a memory in the first embodiment.

The memory section 25 may be constructed in a different way from one illustrated in FIG. 5. FIG. 7 shows another example of a structure of the memory section 25. The illustrated memory section includes a NOR gate 28 which receives results of comparison as a first input from the comparator 24, an inverter 29 for inverting an output transmitted from the NOR gate 28, and a resistor R5 for pulling-up a second input of the NAND gate 28 to the external source voltage VEE. An output transmitted from the inverter 29 is fed back to the second input of the NOR gate 28. An output transmitted from the NOR gate 28 constitutes a negative signal including negation of what is indicated by the detection signal VCNT. The memory circuit illustrated in FIG. 7 operates in the same way as the memory circuit illustrated in FIG. 5.

Figure 8:
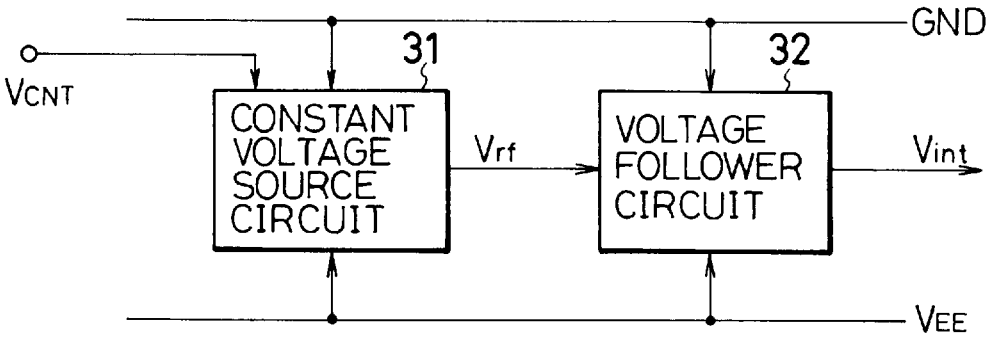
FIG. 8 is a block diagram of an example of an internal source voltage generator in the first embodiment.

FIG. 8 is a block diagram of internal circuits included in the internal source voltage generating circuit 3 illustrated in FIG. 4. The internal source voltage generating circuit 3 includes a constant voltage source circuit 31 and a voltage follower circuit 32. The constant voltage source circuit 31 receives the detection signal VCNT, and transmits a constant voltage level Vrf to the voltage follower circuit 32. The voltage follower circuit 32 transmits the internal source voltage Vint which is adjusted to be equal to the constant voltage level Vrf transmitted from the constant voltage source circuit 31.

As mentioned earlier, the detection signal VCNT acting as a control signal is transmitted into the constant voltage source circuit 31. When an absolute value of the external source voltage much exceeds the threshold voltage VCN, that is, when the detection signal VCNT is on high level, the constant voltage source circuit 31 is deactivated to thereby equalize the output voltage Vrf of the constant voltage source circuit 31 to the external source voltage VEE. The voltage follower circuit 32 remains activated or in operation.

Figure 9:
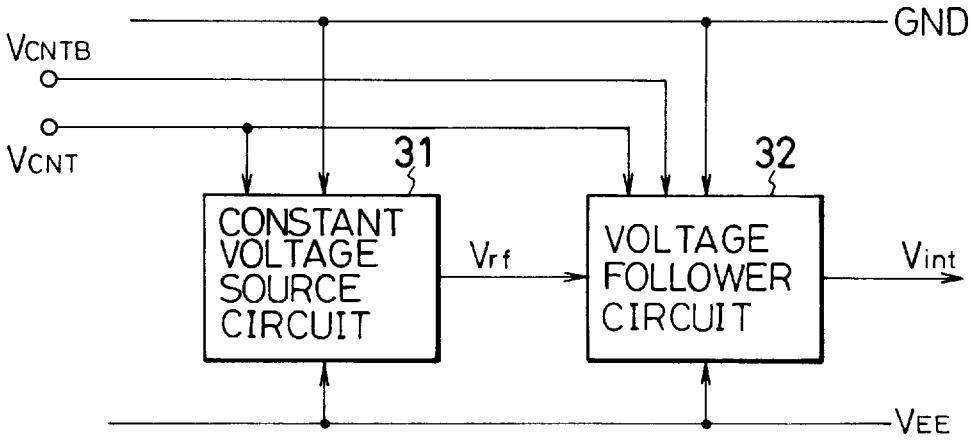
FIG. 9 is a block diagram of another example of an internal source voltage generator in the first embodiment.

FIG. 9 is another block diagram of internal circuits included in the internal source voltage generating circuit 3 illustrated in FIG. 4. The illustrated circuit is different in the circuit illustrated in FIG. 8 in that the detection signal VCNT is transmitted not only to the constant voltage source circuit 31 but also to the voltage follower circuit 32, and that the inverted signal VCNTB is transmitted to the voltage follower circuit 32. In this circuit, when an absolute value of the external source voltage is much exceeds the threshold voltage VCN, the circuits 31 and 32 are deactivated. If necessary, a switch is additionally provided for equalizing the internal source voltage Vint to the external source voltage VEE.

Figure 10:
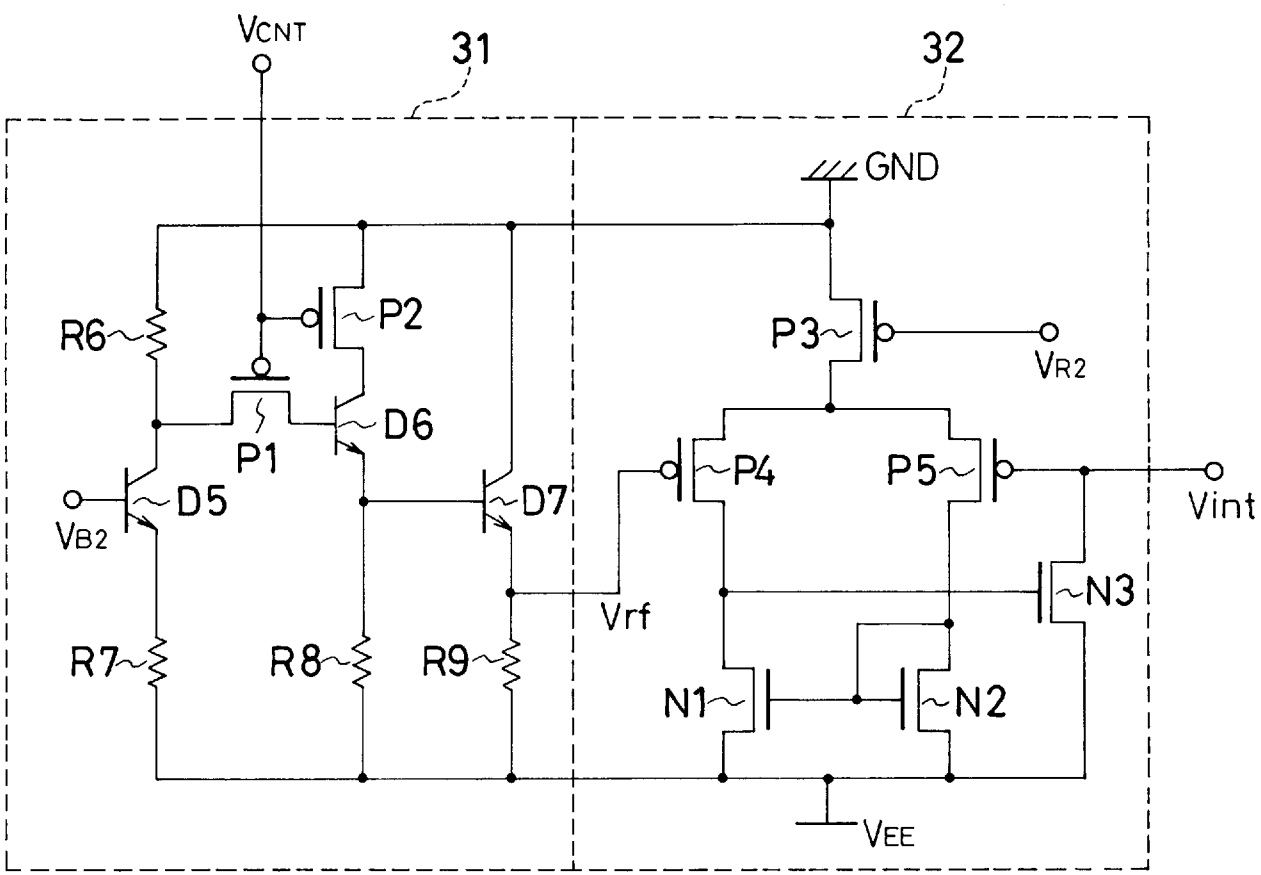
FIG. 10 is a circuit diagram of the internal source voltage generator illustrated in FIG. 8.

FIG. 10 is a detailed circuit diagram of the circuit illustrated in FIG. 8. Constant voltages VB2 and VR2 are determined based on the external source voltage VEE and the grounded voltage GND irrespective of fluctuation in the external source voltage, and are to be produced by means of circuits similar to the constant voltage source circuits 22 and 21, respectively.

The constant voltage source circuit 31 is comprised of p-channel transistors P1 and P2, PNP-type transistors D5 to D7, and resistors R6 to R9. The detection signal VCNT acting as a control signal is transmitted into each of the gates of the transistors P1 and P2. When the detection signal VCNT is on high level, the transistor D6 is turned off to thereby deactivate the constant voltage source circuit 31. As a result, the output voltage Vrf transmitted from the constant voltage source circuit 31 is adjusted to be equal to the external source voltage VEE.

The next stage circuit 32 is a usually used voltage follower circuit, and is comprised of p-channel transistors P3 to P5, and n-channel transistors N1 to N3.

Figure 11:
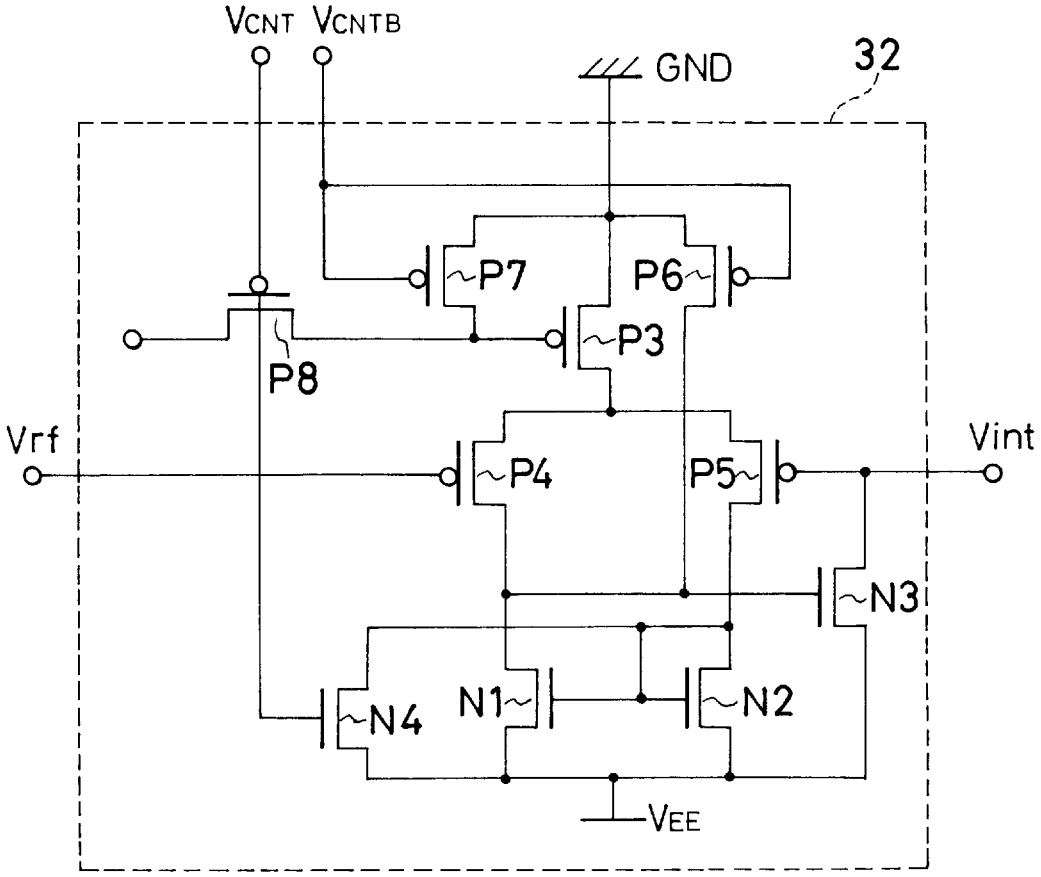
FIG. 11 is a circuit diagram of the internal source voltage generator illustrated in FIG. 9.

FIG. 11 is a circuit diagram of an example of the voltage follower circuit 32 illustrated in FIG. 9. Though not illustrated, next to the voltage follower circuit 32 is arranged the constant voltage source circuit 31 as illustrated in FIG. 10. In the illustrated circuit, p-channel transistors P6 to P8 and an n-channel transistor N4 receive as a gate input the detection signal VCNT and the inverted signal VCNTB constituting complementary control signals, and deactivate the voltage follower circuit 32. The n-channel transistors N1 to N3 and the p-channel transistors P3 to P5 establish the same circuit as the voltage follower circuit 32 illustrated in FIG. 10.

When the inverted signal VCNTB is on low level, the transistor P6 is turned on, and a gate voltage of the transistor N3 is switched to high level, thereby the output voltage Vint being equalized to the external source voltage VEE. Since the voltage follower circuit 32 is deactivated and the output voltage Vint is not influenced by the input voltage Vrf, the constant voltage source circuit 31 may remain as it is. For instance, it is not necessary to transmit the control signal VCNT into the constant voltage source circuit 31.

Figure 12:
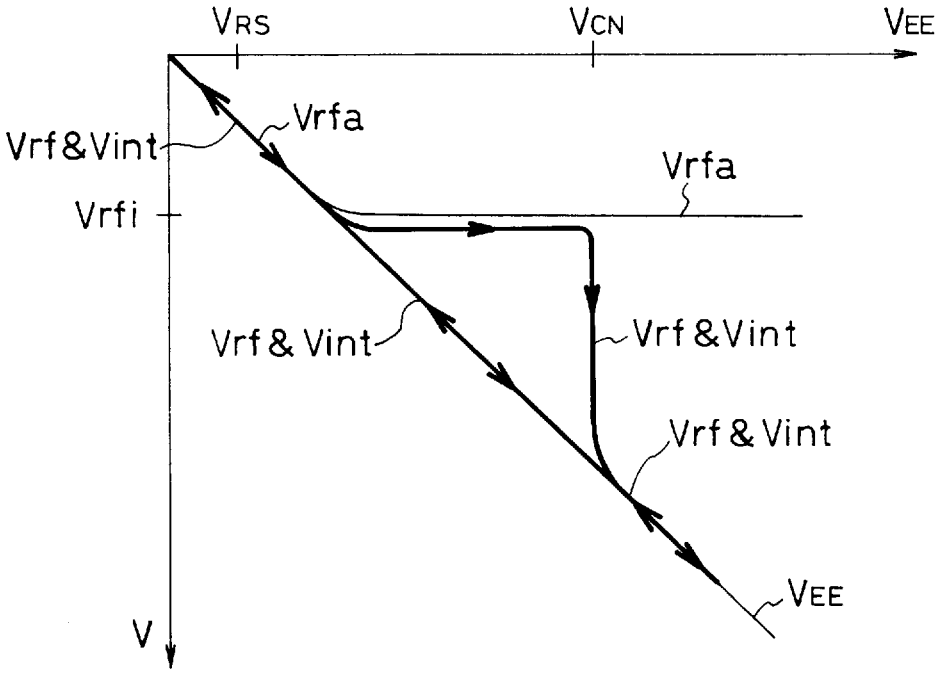
FIG. 12 is a graph showing characteristic of contact voltages to an external source voltage in the internal source voltage generator illustrated in FIGS. 10 and 11.

FIG. 12 shows a characteristic on how the output voltages Vrf and Vint in the circuits illustrated in FIGS. 10 and 11 vary. When an absolute value of the output voltages Vrf and Vint becomes greater than an absolute value of a predetermined external source voltage Vrfi, the output voltages Vrf and Vint are kept to be equal to the constant voltage Vrfi. As an absolute value of the external source voltage VEE increases, the output voltages Vrf and Vint are activated by the detection signal VCNT to thereby be equalized to the external source voltage VEE when the external source voltage becomes equal to the threshold voltage VCN.

Since the detection signal VCNT has the hysteresis characteristic, the output voltages Vrf and Vint remain equal to the external source voltage VEE until an absolute value of the external source voltage VEE becomes smaller than an absolute value of a reset voltage VRS. Thus, it is possible to exactly, readily control the internal source voltage Vint from the outside for a wide range of the external source voltage.

Figure 13:
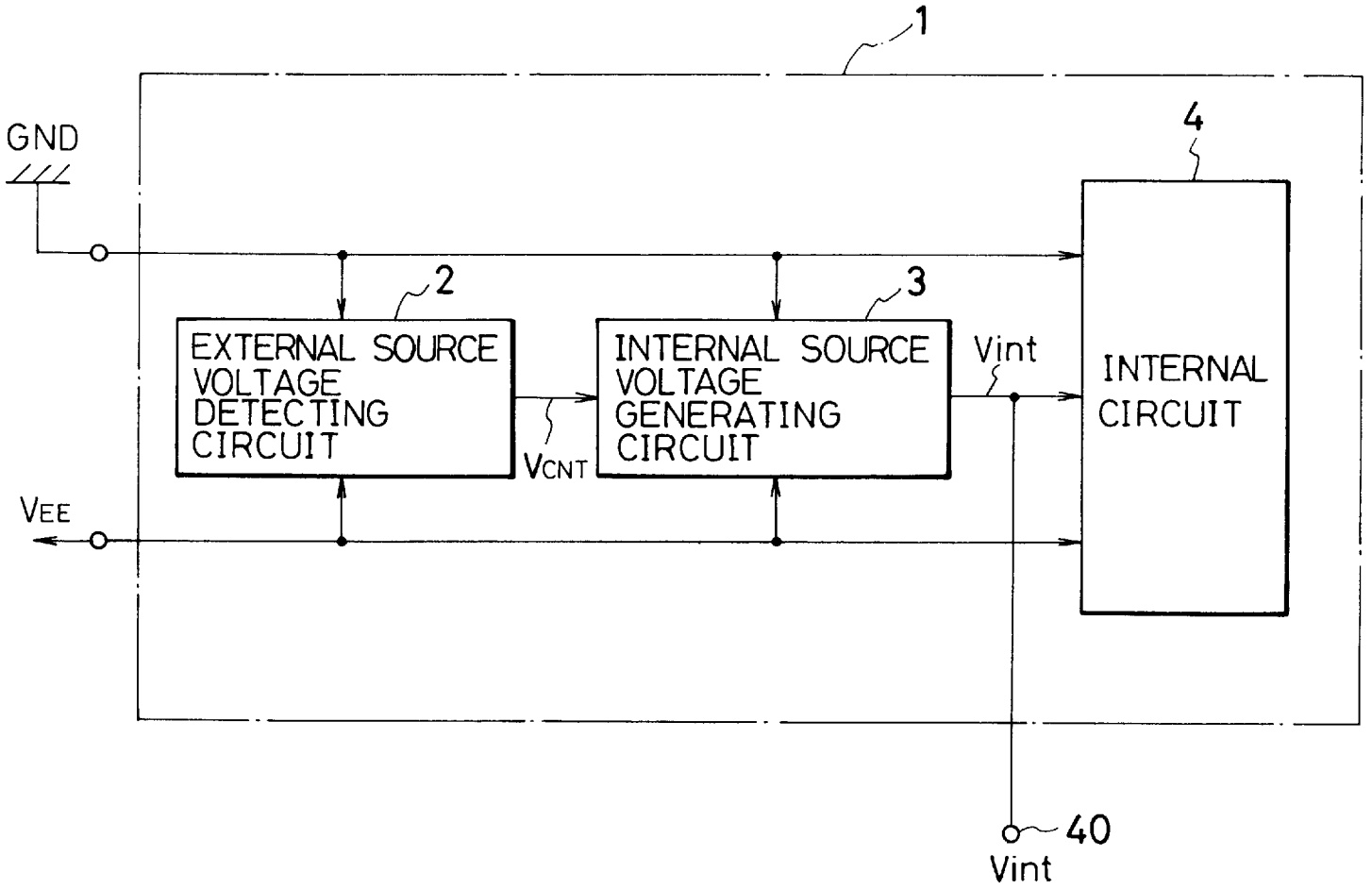
FIG. 13 is a block diagram of the second embodiment in accordance with the present invention.

FIG. 13 is a circuit block diagram of a semiconductor integrated circuit device fabricated in accordance with the second embodiment of the present invention. The illustrated semiconductor integrated circuit device is different from the device illustrated in FIG. 4 only in that the illustrated device has an external terminal 40 through which the output voltage Vint can be lead externally of the device. The output voltage Vint is adjusted to be equalized to the external source voltage VEE by receiving the detection signal VCNT in the first embodiment having been described with reference to FIGS. 4 to 12, whereas the output voltage Vint is adjusted to be in non-controlled condition, that is, in floating condition by receiving the detection signal VCNT in the second embodiment.

Figure 14:
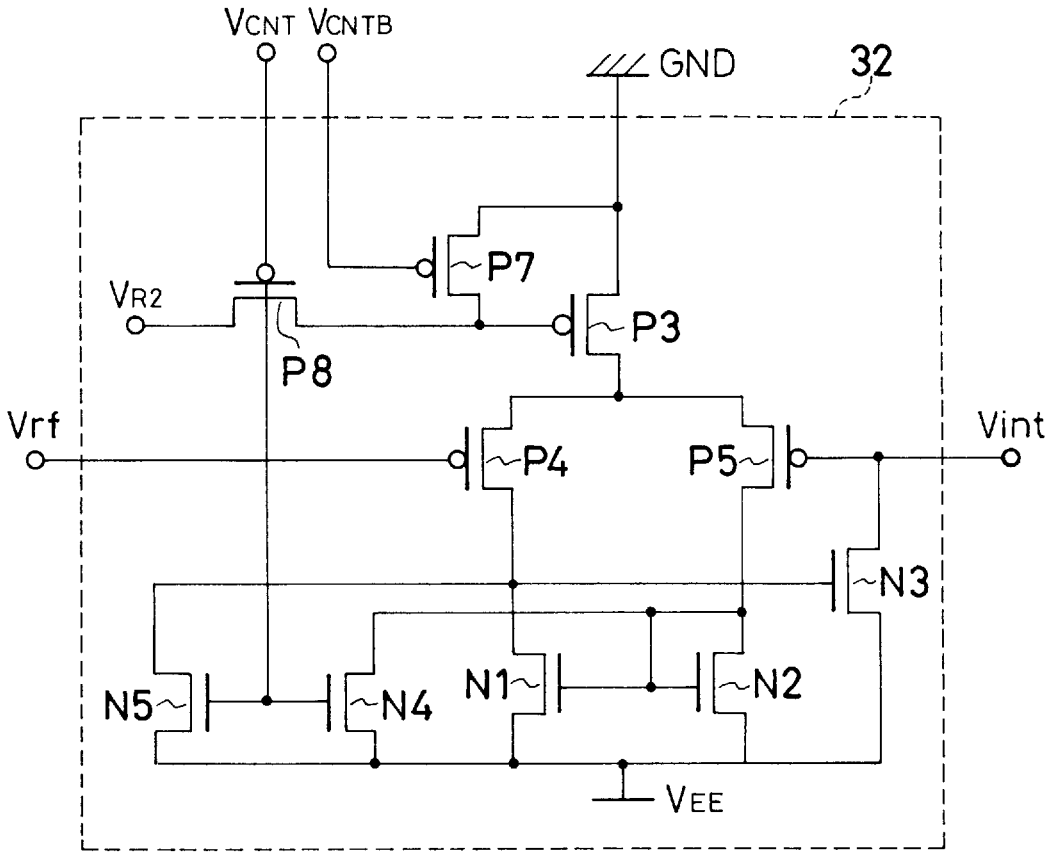
FIG. 14 is a circuit diagram of a part of the second embodiment.

FIG. 14 illustrates a detailed circuit arrangement of the second embodiment. The circuit illustrated in FIG. 14 is similar to the circuit illustrated in FIG. 11, but is different in that an n-channel transistor N5 is substituted for the transistor P6. The n-channel transistor N5 has a drain connected to a gate of the n-channel transistor N3, a source connected to the external source voltage VEE, and a gate connected to the detection signal VCNT. Though it is necessary to additionally provide the external terminal 40 in the second embodiment, it is possible to take an internal source voltage externally of a semiconductor integrated circuit device, and hence, it is also possible to correctly measure a current running through the internal circuit 4 (see FIG. 13).

Figure 1:
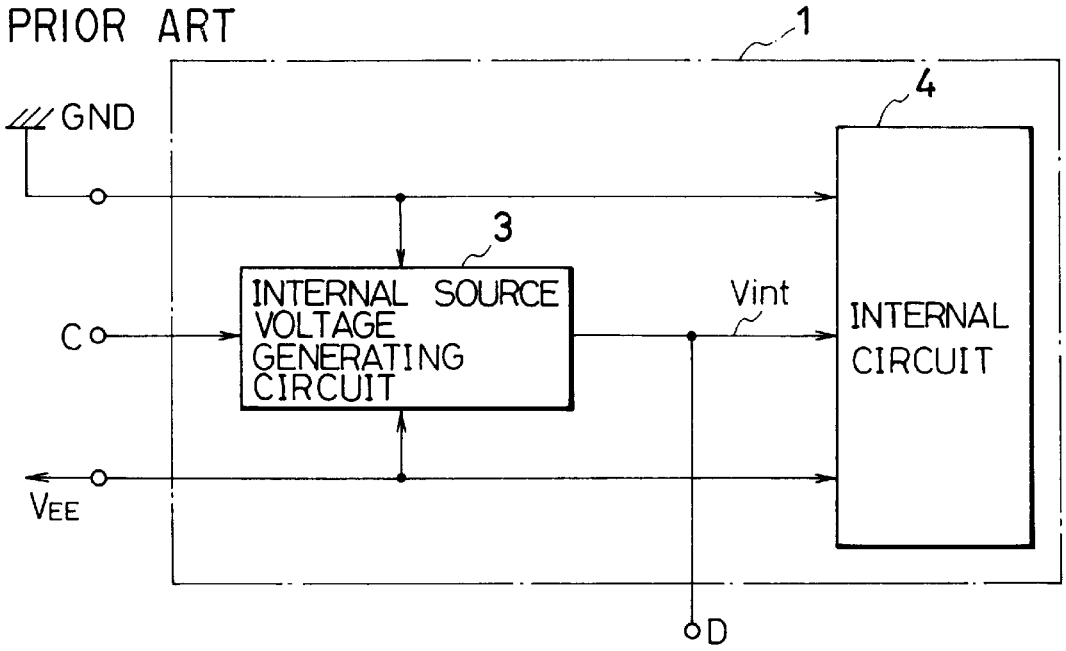
FIG. 1 PRIOR ART
FIG. 1 is a block diagram of an example of conventional semiconductor integrated circuit devices.
Figure 2:
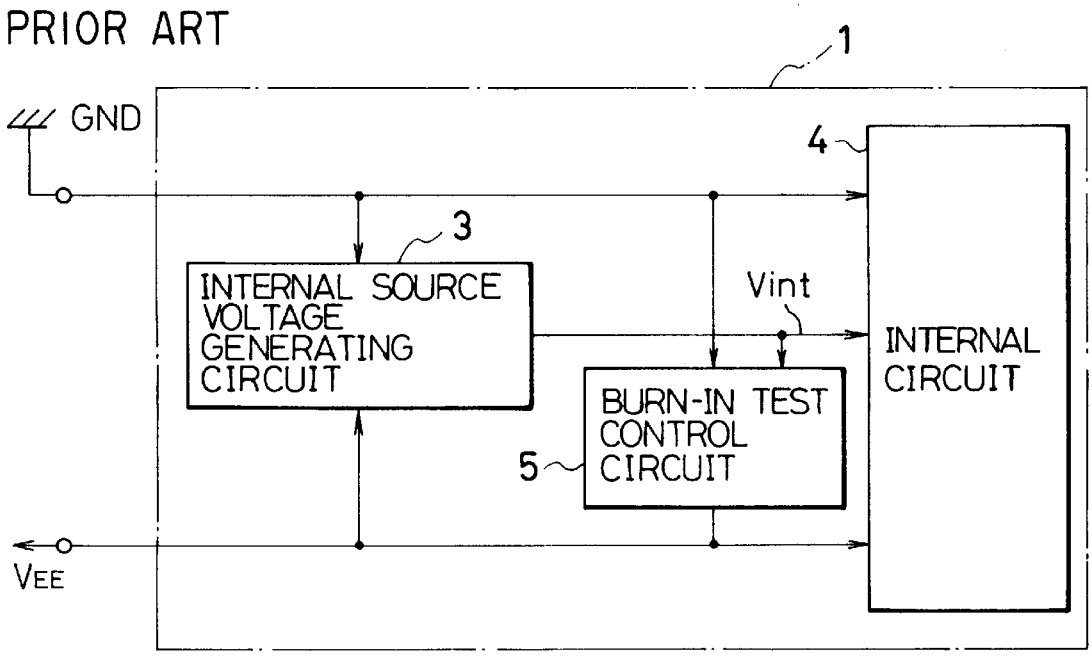
FIG. 2 PRIOR ART
FIG. 2 is a block diagram of another example of conventional semiconductor integrated circuit devices.
Figure 3:
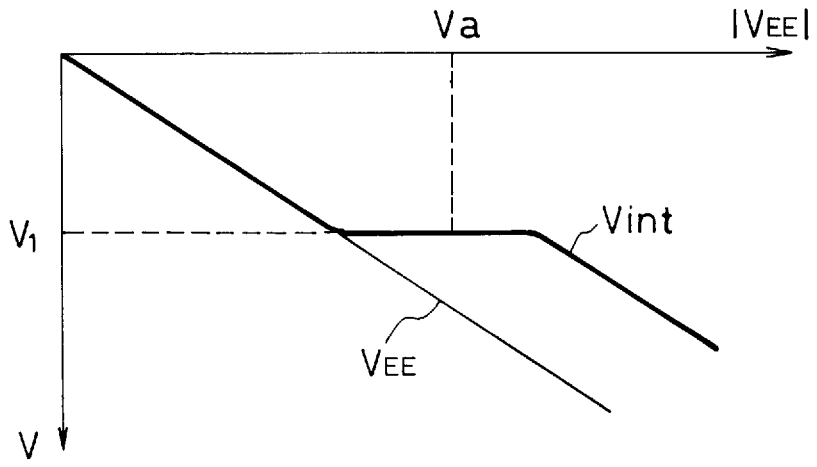
FIG. 3 PRIOR ART
FIG. 3 is a graph showing a characteristic of an internal source voltage to an external source voltage in the conventional semiconductor integrated circuit device illustrated in FIG. 2.
Figure 15:
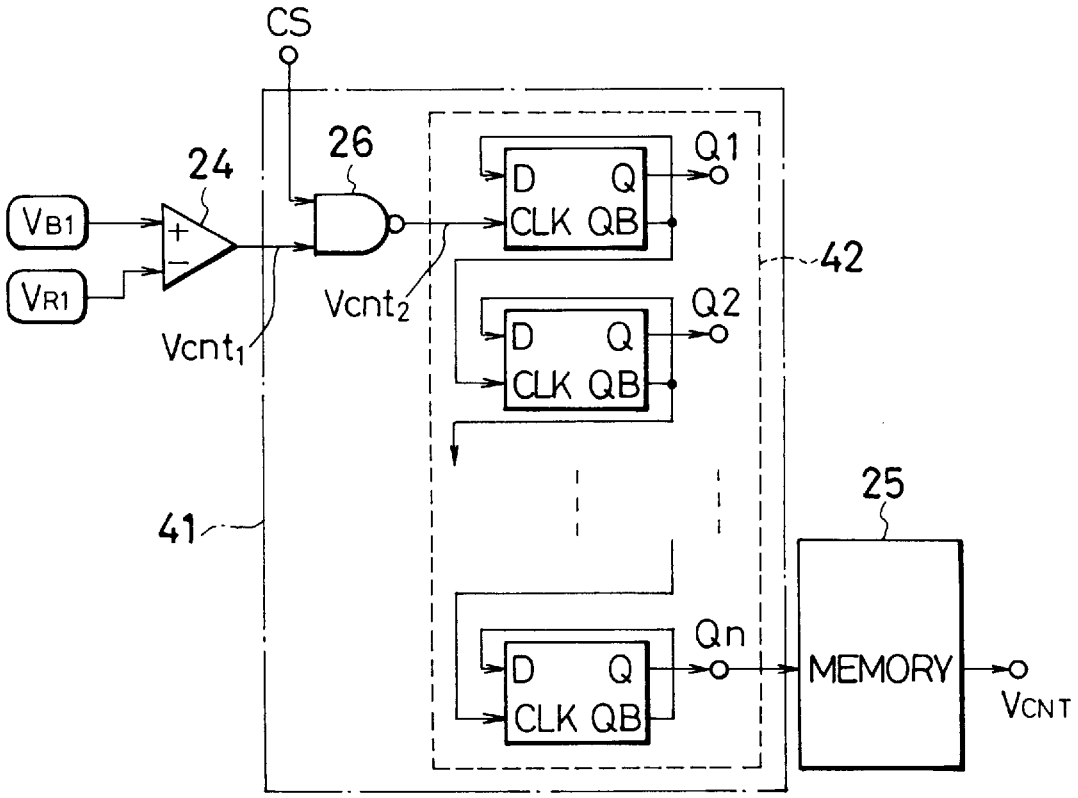
FIG. 15 is a circuit diagram of an external source voltage generator in the third embodiment in accordance with the present invention.

FIG. 15 is a circuit block diagram of a semiconductor integrated circuit device fabricated in accordance with the third embodiment of the present invention. As mentioned with reference to FIG. 2, a semiconductor memory including an internal source voltage generating circuit is generally provided with a circuit for carrying out burn-in test, and is generally designed to control an internal source voltage for the purpose of carrying out burn-in test by making use of a great absolute value of an external source voltage.

Thus, a new circuit arrangement is required in order to cause an internal source voltage characteristic in the present invention and a burn-in test characteristic to coexist. One of such new circuit arrangements is shown in FIG. 15. A circuit illustrated in FIG. 15 is almost the same as the circuit illustrated in FIG. 5, but is different only in that a counter circuit 41 is provided between the comparator 24 and the memory section 25. The signal Vcntl is caused to switch its level between low and high when the external source voltage is equal to the threshold voltage VCN. Hence, it is possible to count the number of up and down in the external source voltage by introducing the signal Vcntl into a clock terminal of a counter section 42 of the counter circuit 41. Thus, it is possible to vary the detection signal VCNT by increasing and decreasing the external source voltage VEE by the predetermined number to thereby equalize the internal source voltage Vint to the external source voltage VEE.

In addition, by establishing NAND logic with a chip selection signal CS and a NAND gate 26, the internal source voltage Vint can be controlled to be equal to the external source voltage VEE in a limited range of the external source voltage, thereby it being possible to prevent the internal source voltage VEE from being unexpectedly equalized to the external source voltage VEE.

Figure 16:
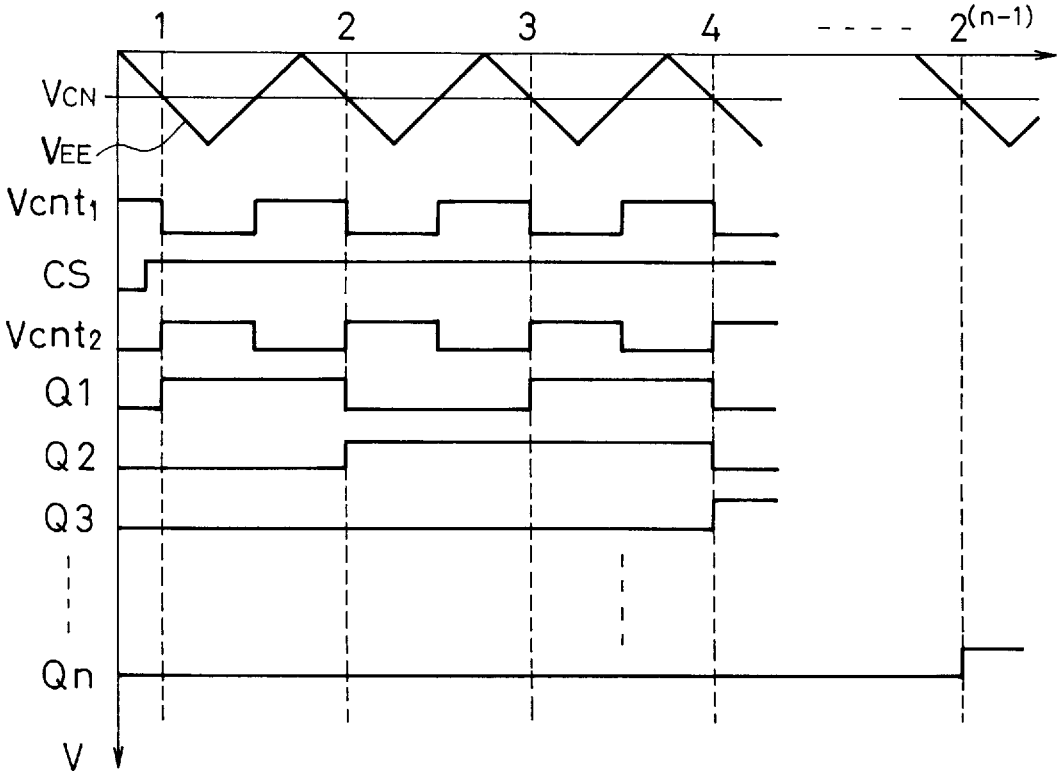
FIG. 16 is a timing chart showing contact voltages in the second embodiment.

FIG. 16 shows operation of the signals indicated in FIG. 15. As is understood in FIG. 16, for instance, when a signal Q3 is to be used, the signal Q3 is switched from low level to high level by increasing and/or decreasing the external source voltage four times, and thus the control signals VCNT and VCNTB can have a hysteresis characteristic by using the memory section 25 illustrated in FIG. 7.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A semiconductor integrated circuit device comprising:

an external source voltage detector for continuously transmitting a first signal after detecting that an absolute value of an external source voltage provided externally of said semiconductor integrated circuit device has exceeded a first threshold voltage; and an internal source voltage generator for generating a constant internal source voltage regardless of said external source voltage while said absolute value of said external source voltage is in a predetermined range, and for providing said external source voltage as an internal source voltage while said first signal is being transmitted, wherein said external source voltage detector comprises:

a first voltage generator for generating a first constant voltage greater than a minimum voltage of said external source voltage;

a second voltage generator for generating a second constant voltage less than a maximum voltage of said external source voltage;

a comparator for comparing said first and second constant voltages to each other; and a memory for storing results of comparison carried out by said comparator.

2. A semiconductor integrated circuit device comprising:

an external source voltage detector for continuously transmitting a first signal after detecting that an absolute value of an external source voltage provided externally of said semiconductor integrated circuit device has exceeded a first threshold voltage; and an internal source voltage generator for generating a constant internal source voltage which varies with hysteresis characteristics in response to fluctuation of said external source voltage, said internal source voltage generator providing:

(a) a constant internal source voltage regardless of said external source voltage while said absolute value of said external source voltage is in a predetermined range, or (b) an internal source voltage while said first signal is being transmitted, wherein said internal source voltage generator comprises:

a reference voltage generator for outputting a constant reference voltage on which said constant internal source voltage is based; and a voltage follower for generating said constant internal source voltage equal to said constant reference voltage, said reference voltage generator being deactivated to provide said external source voltage as said internal source voltage without said voltage follower deactivated while said constant reference voltage is equal to said external source voltage, after said first signal has been transmitted.

3. The semiconductor integrated circuit device as set forth in claim 1, wherein said memory comprises:

a NAND gate which receives said results of comparison as a first input;

an inverter for inverting an output transmitted from said NAND gate; and a resistor for pulling-up a second input of said NAND gate to ground potential, wherein an output transmitted from said inverter is fed back to said second input of said NAND gate, and an output transmitted from said NAND gate comprises said first signal.

4. The semiconductor integrated circuit device as set forth in claim 3, wherein said memory transmits an output from said inverter as an inverted signal of said first signal, together with said first signal.

5. The semiconductor integrated circuit device as set forth in claim, 4 wherein said first signal and said inverted signal have hysteresis characteristic in which levels are switched between high and low when said absolute value of said external source voltage is equal to said first or second threshold voltage.

6. The semiconductor integrated circuit device as set forth in claim 1, wherein said memory comprises:

a NOR gate which receives said results of comparison as a first input;

an inverter for inverting an output transmitted from said NOR gate; and a resistor for pulling-up a second input of said NOR gate to a supply voltage, wherein an output transmitted from said inverter is fed back to said second input of said NOR gate, and an output transmitted from said NOR gate comprises a negative signal including negation of what is indicated by said first signal.

7. The semiconductor integrated circuit device as set forth in claim 1 further comprising a counter for counting a number of transmissions of said first signal, said first signal being transmitted to said memory when said number of transmissions of said first signal reaches a predetermined number.

8. The semiconductor integrated circuit device as set forth in claim 6 further comprising a counter for counting number of transmissions of said negative signal, said negative signal being transmitted to said memory when said number of transmissions of said negative signal reaches a predetermined number.

9. A semiconductor integrated circuit device comprising:

an external source voltage detector for continuing to transmit a first signal after said detector detects that an absolute value of external source voltage provided externally of said semiconductor integrated circuit device has exceeded a first threshold voltage;

an internal source voltage generator for generating a constant internal source voltage regardless of said external source voltage while said absolute value of said external source voltage is in a predetermined range, and for providing said external source voltage as an internal source voltage while said first signal is being transmitted; and a terminal for externally transmitting an output transmitted from said internal source voltage generator, wherein said external source voltage detector comprises:

a first voltage generator for generating a first constant voltage greater than a minimum voltage of said external source voltage;

a second voltage generator for generating a second constant voltage less than a maximum voltage of said external source voltage;

a comparator for comparing said first and second constant voltages to each other; and a memory for storing results of comparison carried out by said comparator.

10. The semiconductor integrated circuit device as set forth in claim 9, wherein said memory comprises:

a NAND gate receiving said results of comparison as a first input;

an inverter for inverting an output transmitted from said NAND gate; and a resistor for pulling-up a second input of said NAND gate to ground potential, wherein an output transmitted from said inverter is fed back to said second input of said NAND gate, and an output transmitted from said NAND gate comprises said first signal.

11. The semiconductor integrated circuit device as set forth in claim 9, wherein said memory comprises:

a NOR gate receiving said results of comparison as a first input;

an inverter for inverting an output transmitted from said NOR gate; and a resistor for pulling-up a second input of said NOR gate to a supply voltage, wherein an output transmitted from said inverter is fed back to said second input of said NOR gate, and an output transmitted from said NOR gate comprises a negated signal of said first signal.

12. The semiconductor integrated circuit device as set forth in claim 9 further comprising a counter for counting a number of transmissions of said first signal, said first signal being transmitted to said memory when said number of transmission of said first signal reaches a predetermined number.

13. The semiconductor integrated circuit device as set forth in claim 11 further comprising a counter for counting a number of transmissions of said negative signal, said negative signal being transmitted to said memory when said number of transmissions of said negative signal reaches a predetermined number.

14. A semiconductor integrated circuit device comprising:

an external source voltage detector for continuously transmitting a first signal after detecting that an absolute value of an external source voltage provided externally of said semiconductor integrated circuit device has exceeded a first threshold voltage; and an internal source voltage generator for generating a constant internal source voltage regardless of said external source voltage while said absolute value of said external source voltage is in a predetermined range, and for providing said external source voltage as an internal source voltage while said first signal is being transmitted, wherein said external source voltage detector continues transmitting said first signal until said absolute value of said external source voltage drops to a second threshold voltage which is less than said first threshold voltage, wherein said internal source voltage generator comprises:

a reference voltage generator for outputting a constant reference voltage on which said constant internal source voltage is based; and a voltage follower for generating said constant internal source voltage equal to said constant reference voltage, said reference voltage generator being deactivated to provide said external source voltage as said internal source voltage without said voltage follower deactivated while said constant reference voltage is equal to said external source voltage, after said first signal has been transmitted.

15. The semiconductor integrated circuit device as set forth in claim 9, wherein said internal source voltage generator comprises:

a voltage follower for generating said internal source voltage equal to a constant reference voltage, said voltage follower being deactivated after said first signal and a second signal, inverted from said first signal, have been transmitted.

* * * * *